US006857933B2

(12) United States Patent
Horta et al.

(10) Patent No.: US 6,857,933 B2
(45) Date of Patent: Feb. 22, 2005

(54) GARMENT UNDERWIRE WITH ZONES OF DIFFERING FLEXIBILITY

(75) Inventors: Joseph Horta, Yonkers, NY (US); Ajit Thakur, Eagleville, PA (US)

(73) Assignee: S & S Industries, Inc., Long Island City, NY (US)

( * ) Notice: Subject to any disclaimer, the term of this patent is extended or adjusted under 35 U.S.C. 154(b) by 47 days.

(21) Appl. No.: 10/245,470

(22) Filed: Sep. 16, 2002

(65) Prior Publication Data

US 2004/0053556 A1 Mar. 18, 2004

(51) Int. Cl.[7] ..... A41C 3/00
(52) U.S. Cl. ..... 450/41; 450/52
(58) Field of Search ..... 450/41, 42, 45–52; 2/255–259, 262, 264

(56) References Cited

U.S. PATENT DOCUMENTS 2,782,417 A * 2/1957 Magidson ..... 450/41
3,562,802 A * 2/1971 Avis ..... 450/41
3,747,606 A * 7/1973 Tareau ..... 450/41
3,777,763 A * 12/1973 Schwartz ..... 450/41
4,271,580 A * 6/1981 King et al. ..... 450/41 X
4,770,650 A * 9/1988 Rowell ..... 450/41
5,219,311 A * 6/1993 Fildan ..... 450/41
5,730,640 A * 3/1998 Acx et al. ..... 450/41
5,951,365 A * 9/1999 Fildan ..... 450/41
6,066,027 A * 5/2000 Fildan ..... 450/52

* cited by examiner

*Primary Examiner*—Gloria M. Hale
(74) *Attorney, Agent, or Firm*—Abelman, Frayne & Schwab

(57) ABSTRACT

An underwire for use with supporting garments, such as brassieres, has one or more zones of increased lateral flexibility along the longitudinal axis of the arcuate member in order to provide greater comfort to the individual wearer, without substantially affecting the arcuate rigidity that provides support. The increased flexibility can be provided by reducing the cross-sectional area, by heat treatment, and by providing a hinge.

52 Claims, 7 Drawing Sheets

FIG. 1A
PRIOR ART
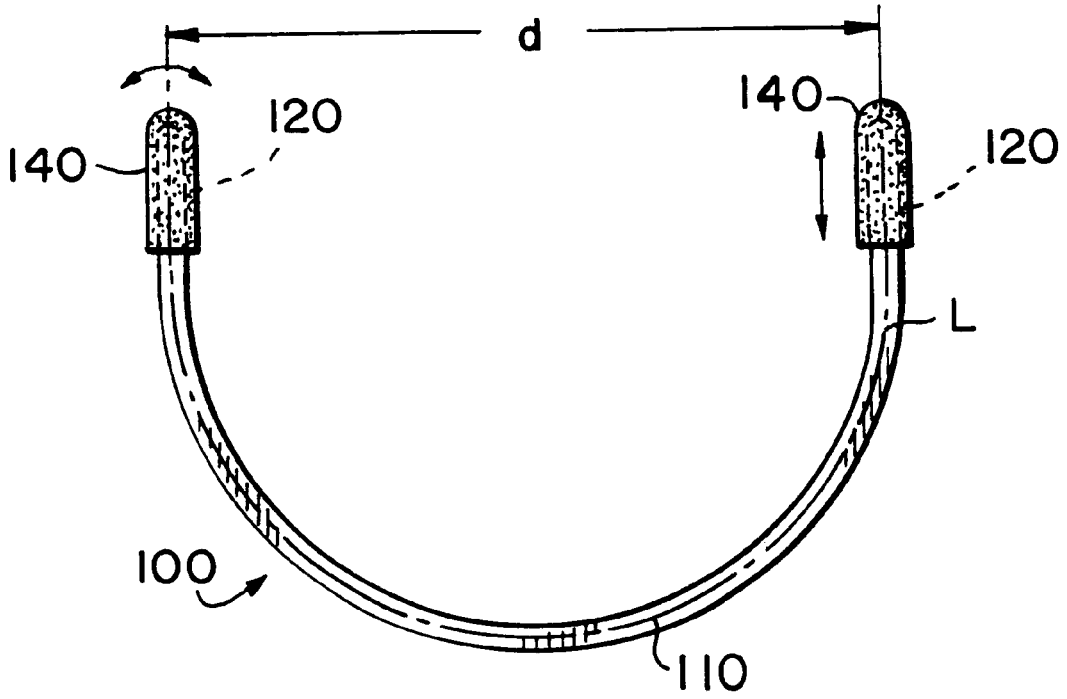
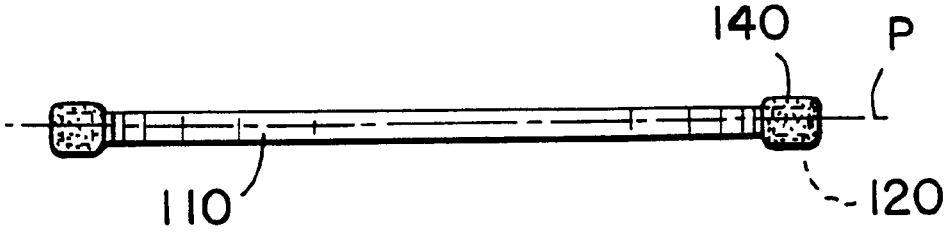
FIG. 1B
PRIOR ART

FIG. 11A
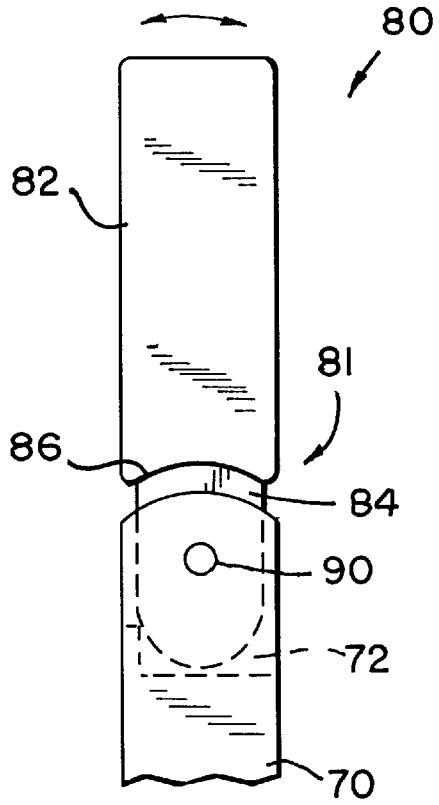
FIG. 11B
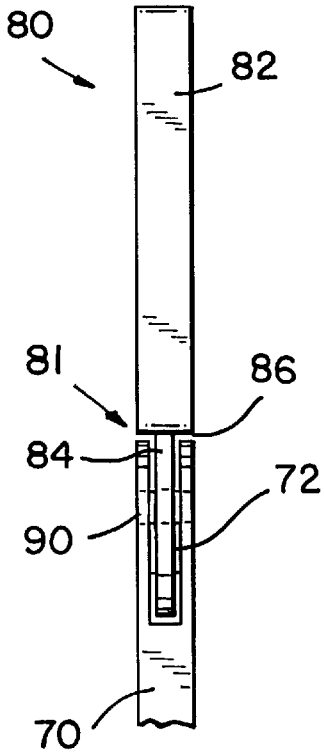
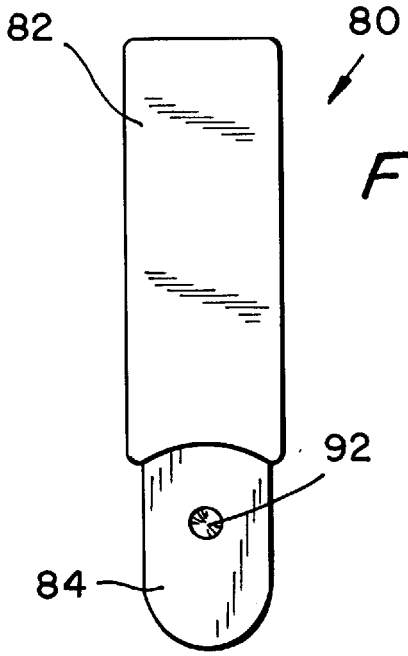
FIG. 12A
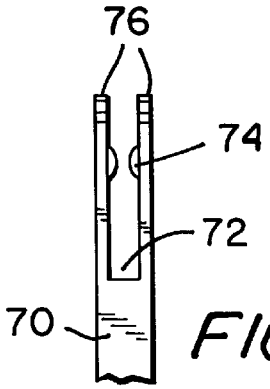
FIG. 12B

GARMENT UNDERWIRE WITH ZONES OF DIFFERING FLEXIBILITY

FIELD OF THE INVENTION

The present invention relates to underwires used in supporting garments. As used herein, the term "supporting garments" is intended to include brassieres, corsets, swim suits, peignoirs and other foundation garments that have breast-supporting cups.

BACKGROUND OF THE INVENTION

Brassieres and similar supporting garments typically include an underwire in the form of a semi-rigid stiffening member of a generally arcuate U-shape that is positioned below the breast cup to provide increased support to the garment. The underwire is placed in an appropriately shaped fabric pocket or sleeve that extends from the central portion and along the lower and outside portions of the breast cup to a position at the wearer's side, under the arm. The resilient underwire of the prior art can be made of a metal, such as steel, having a rectangular, oval or other cross-section, or from polymeric materials in a variety of cross-sectional shapes.

As manufactured, a U-shaped underwire of the prior art has a length "L" defined by a longitudinal axis extending from one end to the other. The underwire also lies flat in an unstressed state, its longitudinal axis lying in a plane. As used herein, "longitudinal plane" means the plane in which the longitudinal axis of the unstressed arcuate member lies When fabricated from metal, the underwire will twist when subjected to a torque applied to its ends. A lateral force applied normal to the plane of the longitudinal axis at a point near one end will also produce a twisting, or torsional movement of the underwire. However, the prior art underwires are essentially stiff and rigid and resist flexing or bending in the portions at either end of the underwire.

When assembled in the supporting garment, the outer end portion or terminus of the underwire is positioned in a soft fleshy area of the wearer adjacent to, or under the arm. The application of lateral forces by the end portion associated with the wearer's movements can be uncomfortable. This discomfort arises because the end portion of the underwire is too rigid to flex or twist outwardly in response to these forces. As a result, the rigid end portion of the underwire, including any cushion tip, presses uncomfortably on, and into the wearer's flesh.

The ends of the underwire, one of which will generally be along the side of the breast proximate the wearer's arm, and the other of which will generally be at the cleavage portion of the breast, distal the wearer's arm, are stiff and rigid, and typically include sharp corners or edges as manufactured. During movement the rigid ends of the underwire, and other portions intermediate the ends, can press uncomfortably against or into the wearer at particularly sensitive portions of the wearer's body. This discomfort is most commonly experienced by wearers of larger cup sizes, individuals having a fleshy torso and those engaged in physical activity that includes stretching, turning and twisting the torso.

In order to alleviate this discomfort, it is well known to provide a soft auxiliary cushion tip of plastic or the like, at the ends of the underwire. Such cushion tips are described in U.S. Pat. Nos. 5,830,040, 3,777,763 and 3,608,556, and represent efforts to provide greater comfort to the wearers of supporting garments constructed with underwires. In this type of prior art underwire, this tip is referred to as a "Comfort Tip".

It is also known to coat the entire length of the arcuate member with a polymeric composition and to provide an enlarged tip at either end, usually of a different type and/or color of polymer or plastic material. The coated underwire and plastic tip can be prepared by spraying and/or dipping the underwire into a liquid composition. In this type of prior art underwire, the tip is referred to as a "hard tip" or "dip tip".

The need for a soft cushion tip such as those disclosed above is also particularly critical should an end of the underwire break through the sleeve or cover of the brassiere that contains the underwire. This can occur after repeated machine washings of the brassiere. Whether the soft coated underwire cushion tip remains within or extends through fabric cover, the tip and end portion of the arcuate member is relatively rigid or stiff and uncomfortable.

In addition, underwires of conventional design do not always allow garments in which they are fitted to flexibly follow movements of the body of the wearer. This is particularly so for wearers requiring a larger cup size, when the wearer leans forward, bends over or twists the torso in such a manner that the tip presses into the sensitive side of the torso and/or breast causing discomfort. While imparting firmness to the supporting structure of the brassiere, underwires of the prior art often do not provide the flexibility necessary for the comfort of the individual wearer. For example, pressure points or sections along the longitudinal axis of the semi-rigid underwire can press uncomfortably against the wearer's ribs and/or flesh.

Other portions along the length of the rigid arcuate member can press against the wearer's torso to create zones of discomfort. These other zones can include the underbust, the breast bone, the rib cage and the region between the underbust and breastbone. As will be understood by one familiar with the art, as well as wearers of supporting garments who have experienced the discomfort and have no experience or interest in designing such garments or underwire assemblies, the precise position will vary with the type, size and style of the supporting garment, as well as the anatomical proportions, posture and physical activities of the wearer.

While soft plastic cushion tips and other alternative underwire constructions have generally achieved commercial and wearer acceptance, there exists a need to provide an improved underwire that exhibits enhanced flexibility at one or more positions along the longitudinal axis and end portions to overcome these and other disadvantages associated with existing underwires.

Accordingly, it is a primary object of the present invention to provide an underwire for supporting garments, such as brassieres, having at least one portion configured for increased lateral flexibility.

Another object of the invention is to provide an underwire of metal or polymer in which the end portion which may support a cushion tip, has greater flexibility in response to lateral forces produced by the wearer.

A further object of the present invention is to provide a garment that is provided with an underwire having at least one end portion configured for increased lateral flexibility to provide enhanced wearer comfort.

As used herein, the term "lateral force" means a force applied in a direction that is normal to the longitudinal axis or longitudinal plane of the underwire in its flat, unstressed condition.

As used herein, the term "flexibility" means the extent to which a portion of an underwire will elastically bend in response to the application of a lateral force, where the lateral force applied does not permanently deform the underwire.

As used herein, "enhanced flexibility" means that a portion of the underwire is relatively more flexible and exhibits greater flexibility in response to the application of a lateral force than an adjacent portion of the underwire.

Another object of the invention is to provide a garment that is specifically designed and constructed to receive a custom-fit underwire assembly that is inserted into the garment at the point of sale to provide maximum comfort to the individual wearer.

A further object is to provide a garment that is constructed to receive an underwire of the present invention that is fitted into and secured in place in the garment.

SUMMARY OF THE INVENTION

The above objects and other advantages are obtained by the improved underwire of the invention that comprises an arcuate or curved, generally U-shaped resilient stiffening frame member having at least one end portion defining a zone of increased flexibility.

When an underwire having only one end portion provided with a zone of increased flexibility is used in the construction of a supporting garment, e.g., a brassiere, that end portion will be positioned, in one preferred embodiment, at the outside of the breast under the wearer's arm. The zone of increased flexibility is more responsive to a lateral force applied to the side of the garment and enhances the comfort of the underwire for the wearer by permitting increased lateral movement and flexibility of the underwire with the garment, particularly during physical activity and upper body movements.

Although providing a zone of increased flexibility at the outer end portion of the arcuate member improves comfort for most wearers of supporting garments, it should be understood that the zone of increased flexibility can be at one or more other positions along the longitudinal axis of the arcuate member. Thus, in its broadest aspect the invention contemplates providing one or more of such zones to customize the underwire to the specific type, style, construction and size of the garment in which it is utilized for the purpose of maximizing the comfort of the individual wearer.

In one preferred embodiment, the zone of increased flexibility includes a predetermined minor length of an end portion that is defined by a substantially smaller cross-sectional area than the cross-sectional area of the remaining portion of the underwire. The smaller cross-sectional area is produced in a conventional metal underwire by reducing the thickness of the arcuate member in a direction normal to the longitudinal axis. The zone of increased flexibility can also be provided by heat treatment, work hardening and by other methods known in the metal working arts. It can also be provided by configuring mold designs in the case of polymeric materials.

In one alternative embodiment, both end portions of the arcuate member define zones of increased flexibility relative to an intermediate portion. The relative flexibility of the respective end portions can be the same or different.

In another alternative embodiment, one or more intermediate portions of the arcuate member define zones of increased flexibility. These one or more intermediate portions can be in combination with such zones at one or both end portions.

As will be apparent to one of ordinary skill in the art, it may be desirable to prepare prototype underwires in accordance with the invention for evaluation in supporting garments of different sizes, materials of construction, designs and styles. For example, the underwire utilized in a corset differs from that used in a peignoir or light-weight supporting garment. For such purposes of evaluation, the one or more zones of enhanced flexibility can be formed by thinning or removing underwire material, such as by grinding or abrading a predetermined length at one or both of the end portions, and/or one or more intermediate portions of a prior art underwire to achieve the desired smaller cross-sectional area. They can also be formed by joining materials of different cross-sections, or having different flexing properties.

In another preferred embodiment, the zone of increased flexibility is provided by perforating at least one portion of the arcuate member of the underwire to reduce the volume of material and thereby provide greater lateral flexibility in response to a lateral force originating in the wearer's torso. Again, prototypes for evaluation can readily be provided by drilling, machining, or otherwise modifying commercially available metal or polymeric underwires of the prior art.

Regardless of the manner in which the one or more zones of increased flexibility are provided, it is to be understood that the arcuate rigidity of the assembly should be maintained to the extent required to assure the proper form fitting of the garment. That is, the arcuate rigidity should not be substantially reduced.

The first and second ends are also preferably provided with cushion tips of a soft material, such as a soft polymeric material, to cover the metal at the outermost ends of the underwire. The tips can be fixed or movably mounted and can be configured and fitted or applied to the ends of the underwire in accordance with any of the forms, shapes, materials and methods now known and utilized in the prior art, or that may be developed in the future.

In another embodiment of the invention, the outer end portion of the arcuate member comprising the zone of increased flexibility is permanently turned or twisted at an angle of from about 30° to 90° from the longitudinal plane.

Thus, in one preferred embodiment the improved underwire of the invention broadly contemplates:

a generally U-shaped arcuate member the longitudinal axis of which lies in a plane, the arcuate member having a first portion extending from a first end that includes a majority of the length of the arcuate member, and a second portion that includes the remainder of the arcuate member, the second portion having a substantially greater flexibility than the first portion in response to a force applied in a direction normal to the plane of the longitudinal axis of the arcuate member, whereby the second portion defines a zone of increased flexibility.

In another preferred embodiment, the invention further contemplates an underwire for use in supporting garments comprising:

a generally U-shaped arcuate member the longitudinal axis of which lies in a plane, the arcuate member having a first end portion extending a predetermined distance from a first end of the arcuate member, a second end portion extending a predetermined distance from the other end of the arcuate member, and an intermediate portion extending between the first and second end portion, at least one of the first end, second end and/or intermediate portions including a zone of increased flexibility that has a substantially greater flexibility than a contiguous adjacent segment in response to a force applied in a direction normal to the plane of the longitudinal axis of the arcuate member.

In yet another preferred embodiment, the invention contemplates an underwire with a polymeric coating to enhance comfort to the wearer.

The invention also includes a brassiere or other supporting garment that incorporates the underwire of the invention carried in a channel or sleeve sewn into the garment, where at least the end portion of the underwire lying at the side of the garment has a zone of greater flexibility than the adjacent central portion of the underwire. In this context, the invention contemplates an underwire for a brassiere comprising;

a substantially U-shaped frame member having a first terminal end portion, a second terminal end portion and an intermediate portion located between and integral with each of the terminal end portions;

the first terminal end portion assembled in the garment at a location proximate a wearer's arm, the first portion defining a flexible zone of predetermined length having a reduced cross-section and/or a plurality of perforations, and the second terminal end portion comprises a flexible zone of a predetermined length having a plurality of perforations, wherein the first and second terminal end portions have greater lateral flexibility than the intermediate portion.

In yet a further improvement in the comfort of the supporting garment, the arcuate member is provided with a hinge member proximate at least one end portion, the axis of the hinge being aligned to permit movement of the end portion of the arcuate member in response to a force applied normal to the plane of the longitudinal axis. The hinge member is constructed to resist flexing or deformation forces that are parallel to the longitudinal plane of the underwire. This permits the underwire to perform its shape-retaining function, while providing improved comfort to the wearer. In use, the hinged segment of the arcuate underwire member is preferably assembled to the garment in a close-fitting sleeve that can be formed from a shape-retaining fabric. Thus, the sleeve itself will also determine the eventual flexibility of the end portion of the hinged arcuate member.

The use of a hinge member is preferred in underwires fabricated from polymeric materials. The use of polymeric compositions allows the end portion and adjacent portion of the arcuate member to be molded with a so-called living hinge, a ball joint, or with rotationally interlocking elements. The hinge pin can also be integrally molded, if desired.

Additional features and advantages of the invention are set forth in the detailed description which follows, and will be readily apparent to those skilled in the art from that description or by practicing the invention as described herein, including the claims and the appended drawings.

BRIEF DESCRIPTION OF THE DRAWINGS

FIG. 1A is a top plan view of a typical prior art underwire assembly that is provided with cushion tips;

FIG. 1B is a side elevation view of the prior art underwire assembly of FIG. 1A;

FIG. 11A is a top plan view of a portion of the end of a hinged underwire in accordance with another embodiment of the invention;

FIG. 11B is a right side view of the underwire illustrated in FIG. 11A;

FIG. 12A is a top plan view of the end member of a hinged underwire; and

FIG. 12B is a side view of a portion of the end of an arcuate underwire that is adapted to receive the end member of FIG. 12A.

DETAILED DESCRIPTION OF THE PREFERRED EMBODIMENTS

Figures 2, 3A, 3B, 4:
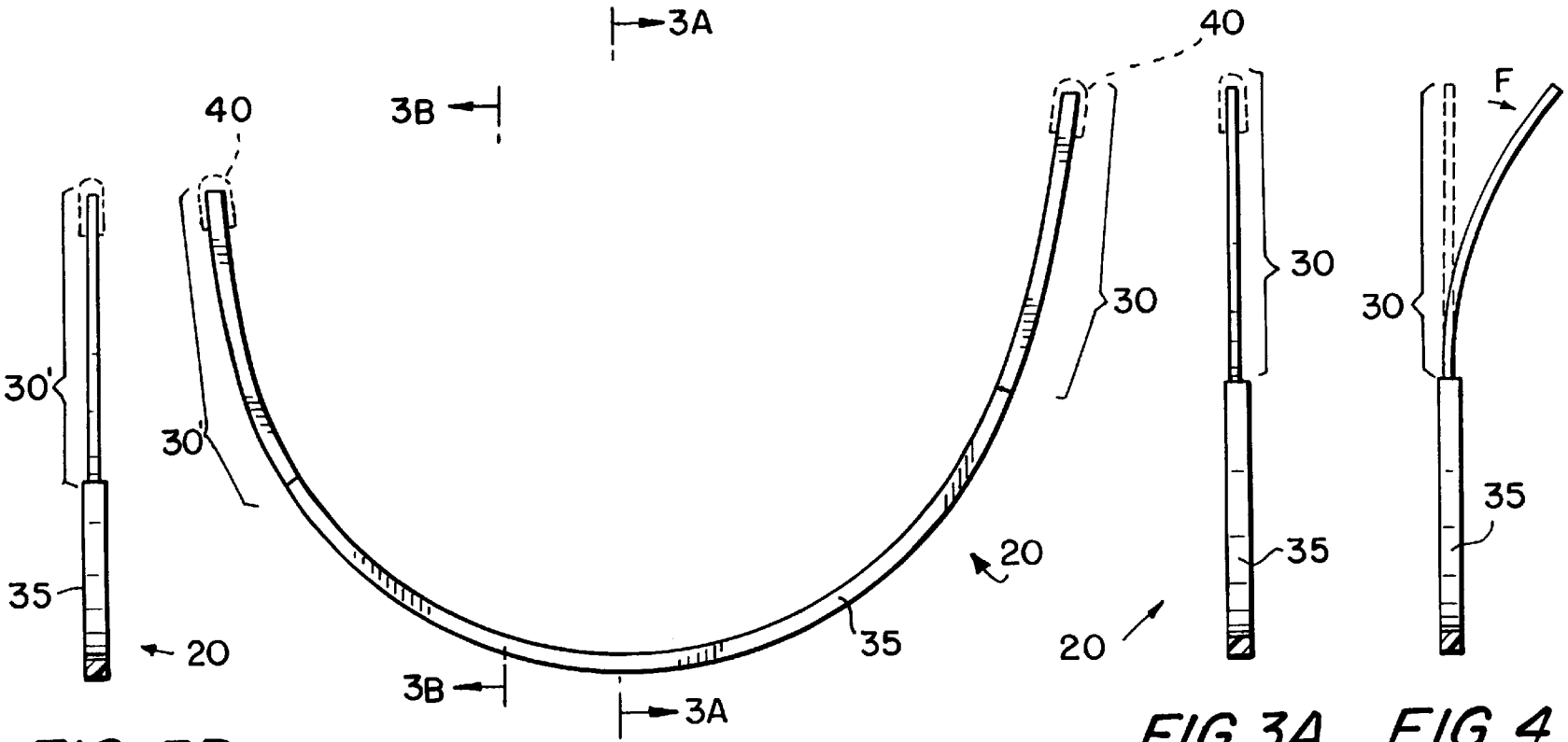
FIG. 2 is top plan view of an improved flexible brassiere underwire in accordance with one embodiment of the present invention.
FIG. 3A is a cross-section view taken along section line 3A—3A of FIG. 2.
FIG. 3B is a cross-sectional view taken along section line 3B—3B of FIG. 2.
FIG. 4 is a cross-sectional view similar to FIG. 3A with an end portion in a laterally displaced position.
Figure 5A:
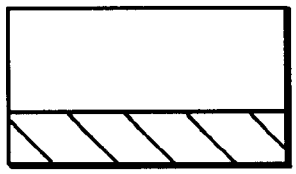
FIGS. 5A–5F are cross-section views of a portion of arcuate members of increased flexibility in the direction of an intermediate portion of greater cross-sectional area.
Figure 5B:
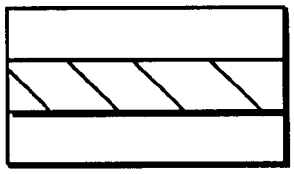
Figure 5C:
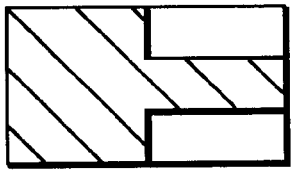
Figure 5D:
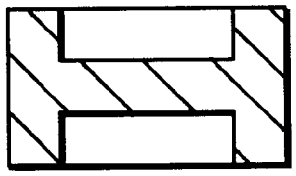
Figure 5E:
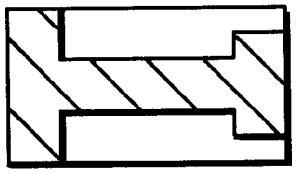
Figure 5F:
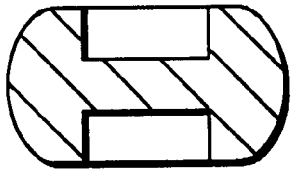

Reference will be made to several preferred embodiments of the invention, examples of which are illustrated in the accompanying drawings FIGS. 2–6. Wherever possible, the same reference numbers will be used throughout the drawings to refer to the same or like elements.

An exemplary embodiment of an underwire assembly of the prior art is shown in FIG. 1, designated generally by reference numeral 100. The opposing ends 120 are fitted with cushion tips 140. In the embodiment of FIGS. 1A and 1B, the underwire 110 is fabricated from metal and its longitudinal axis "L" lies in longitudinal plane "P". This type of prior art underwire resist forces that would tend to change the lateral distance "d" between the tips 140. Although not entirely rigid, the underwire also resists twisting forces of the type that are developed when the underwire 110 is sewn into place in the supporting garment (not shown).

The cross-section of the prior art underwire taken along substantially the entire longitudinal axis is uniform, e.g., rectilinear, as shown in FIG. 1B. Some departure from the uniform cross-section may appear at the extreme ends in order to accommodate or provide a structure for mounting cushion tips. For example, it is known to provide one or more perforations at one or both ends of the underwire for slidably or pivotally mounting the soft cushion tip. However, these modification to the end of the underwire have no appreciable effect on the flexibility of the adjacent end portion(s) of the underwire on which such movable tips are mounted. That is to say, such modifications as are known to the prior art do not provide a zone of flexibility as contemplated by the configuration and method of the present invention.

As will be understood by one of ordinary skill in the art, the underwires of the prior art, including those fitted with soft movable cushion tips at the end positioned on the wearer's side often cause discomfort. This is due to the fact that the change in effective longitudinal length of the underwire fitted with a slidably moveable tip is insufficient to relieve the lateral pressure applied to wearer's torso by the relatively inflexible end portion of the underwire Referring now to FIGS. 2–4, there is depicted one embodiment of the improved underwire of the invention. Underwire assembly 20 is a monolithic arcuate U-shape member 10 having opposing ends, a predetermined length or a portion of at least one end defining a zone of increased flexibility 30. When placed in position in the supporting garment, e.g., a brassiere, this zone of increased flexibility 30 will be proximate the wearer's side or underarm. The opposite end portion 30' is located distal to portion 30 and an intermediate portion 35 is located between and integrally formed with the first and second portions. As shown in the side view of FIG. 3A, the zone of increased flexibility 30 enhances the comfort of underwire 20 for the wearer by permitting improved lateral flexibility during physical activity and body movements, or simply by allowing the end to extend outwardly away from the wearer's side or underarm in response to the lateral force(s) exerted by the wearer's torso.

In a preferred embodiment depicted in FIGS. 2, 3A and 3B, the zone of increased flexibility 30 includes a predetermined length of a first end portion having a substantially smaller cross-sectional area than the cross-sectional area of the adjacent intermediate or remaining portion of the underwire, thereby providing greater lateral flexibility to the first end portion.

In the embodiment illustrated in FIG. 2, both terminal or end portions 30 and 30' are provided with zones of increased flexibility 30 relative to the intermediate portion 35, thereby improving the lateral flexibility of both end portions of underwire 20. The desirability of increasing the flexibility of both end portions will be based on a number of factors, including the nature of the supporting garment and the design and material of construction of the underwire.

As shown in FIG. 4, application of a lateral force F causes a displacement of zone 30, while having little or no effect on the more rigid adjoining portion.

The region of enhanced flexibility is preferably formed by shaping, molding, thinning or removing underwire material, such as by grinding, abrading, stamping, extruding, rolling or etching a predetermined length of the underwire or by joining materials of different cross-sections and/or flexibilities. The underwire can be metallic or nonmetallic, uncoated or coated over all or part of its length with a polymer coating, the composition of which is well-known to the art. The outermost ends of first and second terminal end regions preferably include cushion tips or dip tips 40 of a resilient material, such as a soft plastic, soft resin or the like, to coat sharp edges that may be present.

In the practice of the invention, particularly with metal underwires, it is important that the rigidity of the arcuate member with respect to its original, unstressed arcuate shape or configuration be maintained. This characteristic, which will be referred to as "arcuate rigidity," is important to the function of the underwire in maintaining the shape of the brassiere or other supporting garment.

In view of the above considerations, several preferred embodiments of the portion of increased flexibility of the arcuate member are illustrated in the cross-sectional views of FIGS. 5A–5F. As shown in these figures, the portion or portions of increased flexibility have a transversely extending segment that is of the same width, or substantially the same width as the original width of the intermediate portion, or adjacent segment(s). This construction allows a lateral bending or displacement of the underwire, while at the same time, minimizing the effect of the reduced cross-sectional area on the desired arcuate rigidity.

Figure 7:
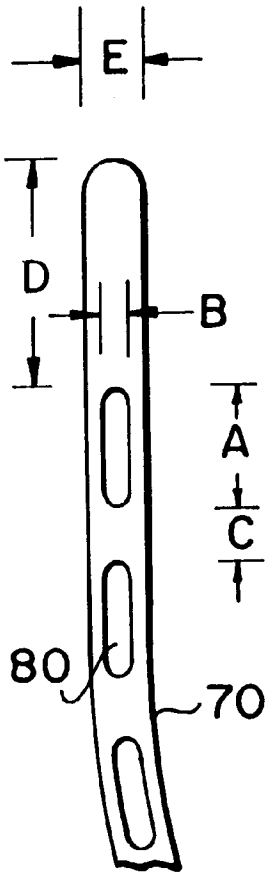
FIG. 7 is a dimensioned detail of the underwire of FIG. 6.
Figure 6:
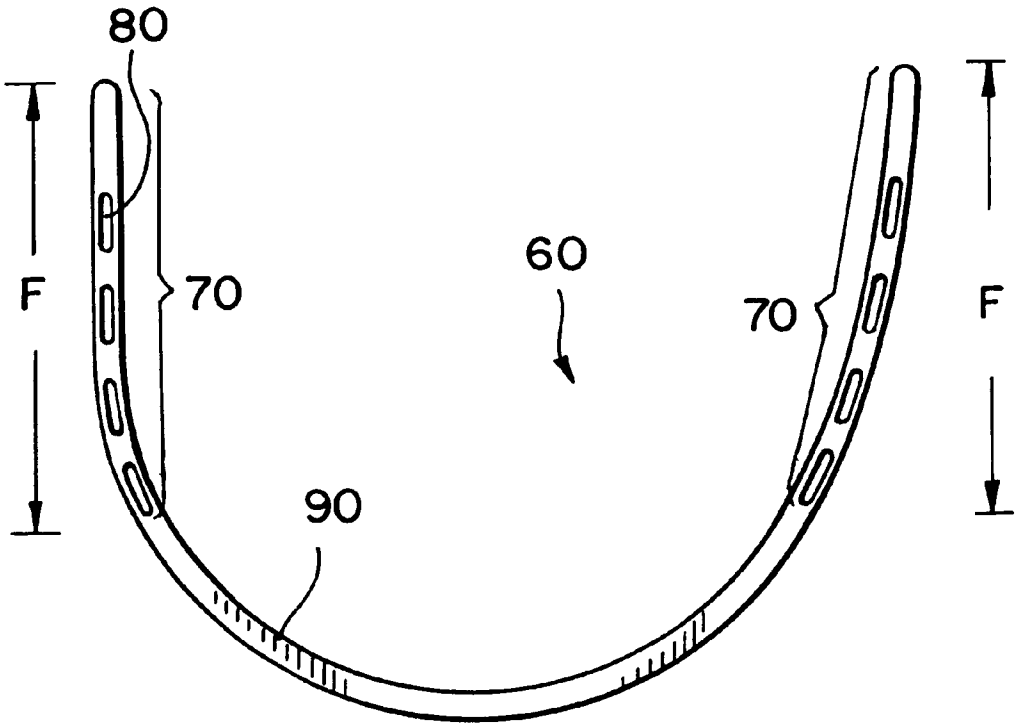
FIG. 6 is a top plan view of an underwire in accordance with another embodiment of the present invention.

In another preferred embodiment, illustrated in FIGS. 6 and 7, underwire 60 is shown with zones of increased flexibility defined by a predetermined length of both first and second terminal end portions 70 having perforations 80 located therein. As a result of the reduction in the average cross-sectional area, first and second terminal end portions have greater lateral flexibility relative to the flexibility of the intermediate portion 90, thereby improving the comfort of underwire 80.

Although not specifically depicted in the attached illustrative drawings of the invention, it is to be understood that the underwires formed from metal include generally rounded quater-fillets where the narrower portions meet the portions of larger cross-section. These fillets provide enhanced strength to the construction and reduce the tendency of the metal to form cracks that propagate from sharp inside corners or shoulders. Similarly, fillets are also provided in the molded polymeric underwires, where they serve a similar purpose and also facilitate removal of the piece from the mold.

As depicted in FIGS. 6 and 7, openings 80 are oblong; circular or other shapes can be employed to define the perforations or opening(s) 80. In the specific embodiment illustrated, the openings 80 are about ¼" long and about 1/16" inch wide. There is preferably about ⅛" between adjacent perforations, preferably about ½" between the top of the first perforation and the end of the underwire, and preferably about 2" from the outermost end of the underwire to the lowermost portion of the last perforation. The first and second terminal end portions depicted in FIGS. 6 and 7 can also include cushion tips or dip tips (not shown).

Figure 8:
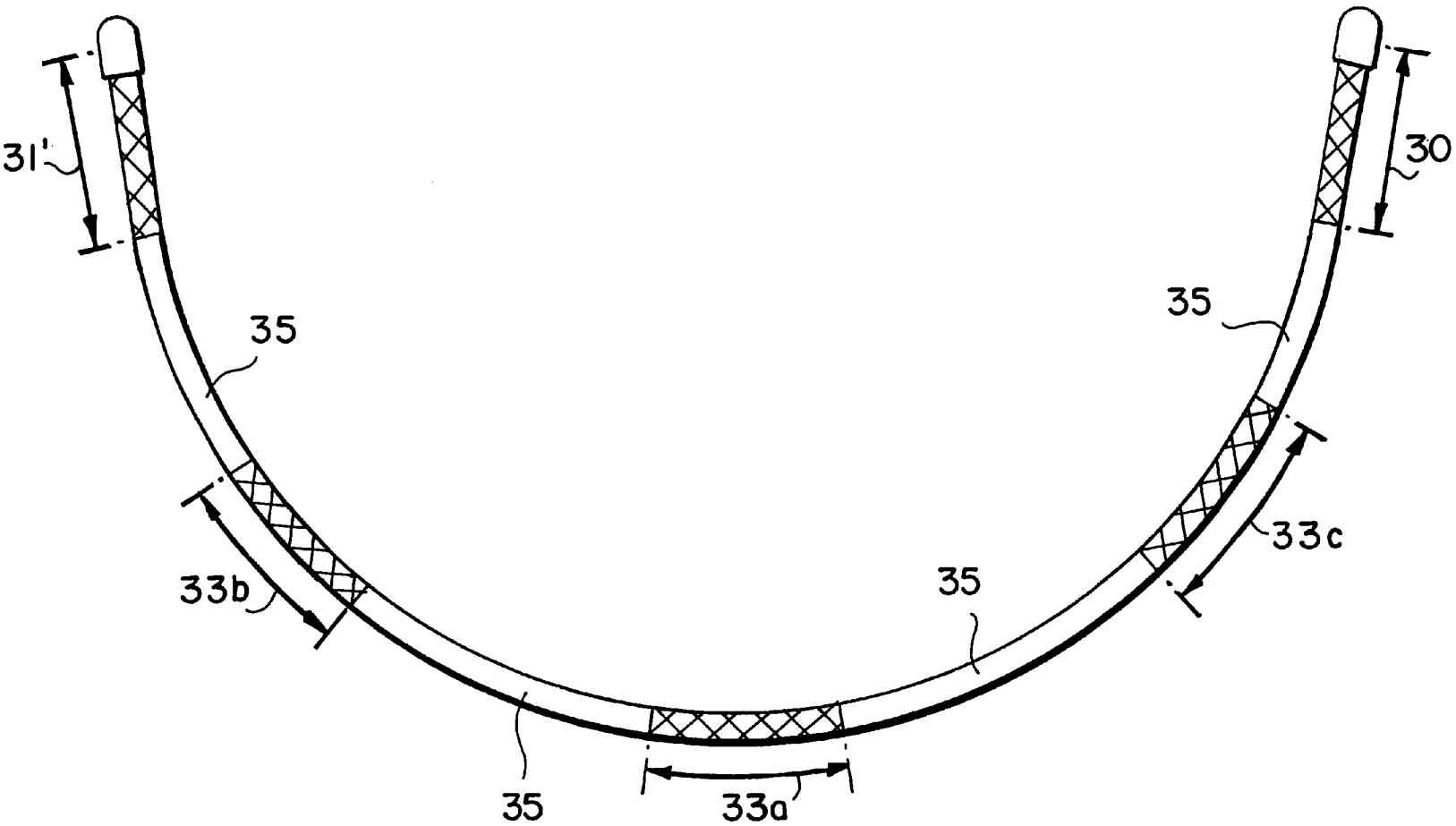
FIG. 8 is a top plan view of an underwire in accordance with another embodiment of the invention.

A further preferred embodiment of the invention is schematically illustrated in FIG. 8 where there is depicted an arcuate member 20 having a plurality of zones of increased flexibility in spaced relation along the longitudinal axis of the intermediate portion 35. It is to be understood that the number, spacing, axial length and relative flexibility is determined based upon the design factors discussed above. These design factors can include the size of both the supporting garment and the cup, the style and type of the garment, as well as its material(s) of construction.

With continuing reference to FIG. 8 the underwire has zones of increased flexibility at opposing end portions 30 and 31; in the region of the underbust 33*a*; in the vicinity of the breastbone 33*b*; and proximate the ribcage 33*c*. The intermediate portions 35 are of consistent cross-sectional area that is greater than the cross-sectional areas of the respective zones of increased flexibility 30, 31, 35*a*–35*c*. The cross-section configuration of each of the zones of increased flexibility can be as shown in FIGS. 5*a*–5*f*.

Figures 9, 10:
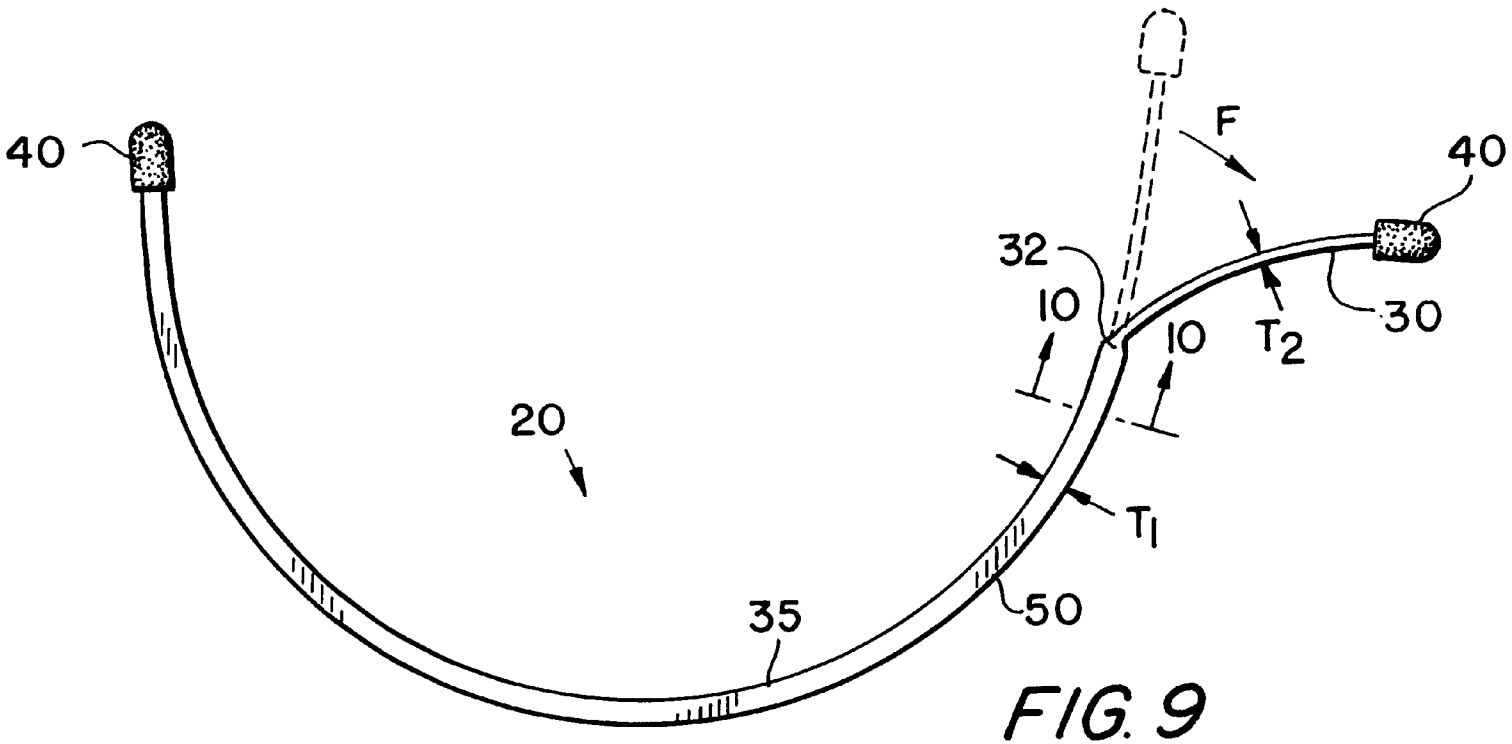
FIG. 9 is a top plan view of an underwire in accordance with another embodiment of the invention.
FIG. 10 is a cross-sectional view taken along line 10—10 of FIG. 7.

With reference to the embodiment illustrated in FIG. 9, the underwire 20 is formed of a molded polymer. As shown in FIG. 10, the cross-section of the majority of the arcuate member 50 is square, or nearly so. The zone of increased flexibility 30 is preferably joined to the first portion 50 by a tapered transition portion 32. The transition portion 32 is provided to minimize stress, strain and fracture points that are known to occur in the molding of various polymeric compounds.

The transverse or lateral thickness $T_1$ of first portion 50 is substantially greater than the corresponding thickness $T_2$ of second end portion 30.

In the embodiment illustrated in FIGS. 9 and 10, the width of the first and second portions are the same, or nearly so. Alternatively, both the thickness and width of the end portion can be varied over the length of zone 30 to achieve the desired degree of relative flexibility for a particular garment, based on its size, style and the choice of materials from which the garment and the underwire are produced. As shown in FIG. 9, when a lateral force F is applied to portion 30 it bends elastically without permanent deformation.

When the underwire is produced from a molded polymer, the end portion 30 can be of approximately the same width as the more rigid intermediate portion 35, but turned at an angle to the plane of the longitudinal axis of the rest of the underwire 20. The angle can be made up to 90°. The optimum angle of displacement from the plane is determined with reference to the type and style of the garment, and the other factors described above.

In an alternative embodiment similar to that shown in FIG. 9, the arcuate member is fabricated from a polymeric composition and the end portion for which greater flexibility is desired is defined by a transverse living hinge that is formed proximate the transition zone 32. The design and configuration of living hinges is well known in the art and is provided by molding the arcuate member with a relatively narrow region that is substantially thinner than end portion 82 and intermediate portion 70. The configuration of the living hinge must be such that the arcuate rigidity of the underwire is not substantially reduced, and the living hinge has sufficient tensile strength to resist tearing and stress fractures during the expected useful lifetime of the garment.

As will be apparent to those of ordinary skill in the mechanical arts, various other types and configurations of common structures, such as ball and socket joints can be utilized to permit lateral movement of the end portion of the underwire. As used herein, the term "hinge member" is intended to include the constructions specifically described above and their mechanical and functional equivalents.

The improved underwires of the invention can be produced from all of the materials from which underwires of the prior art have been produced. These include carbon steel, stainless steel and other metal alloys. Polymeric materials including, but not limited to, polyethylene, polypropylene, polyvinyl chloride, acrylonitrile-butadiene, styrene, methacrylates, polycarbonates, nylon and copolymers and homopolymers of these compounds.

Sufficient material must remain in the zone of increased flexibility 30 to avoid permanent deformation of the end portion. As will be understood by one of ordinary skill in the art, the relative reduction in cross-sectional area of the end portion(s), whether by thinning or perforations, can be determined for a particular application based on the type of material used to make the underwire.

In the illustrations of FIGS. 11A and 11B, one embodiment of a underwire 80 constructed with a hinge member 81 includes end portion 82 that is joined to intermediate arcuate portion 70 by a separate hinge pin 90. The leaf portion 84 is received for rotation in channel 72 and secured by pin 90. As will be understood from FIG. 11A, the channel 72 can be configured so that the end portion 82 is allowed to rotate in only one direction and up to a predetermined angular displacement.

In a further modification of the hinge member, there is illustrated in FIGS. 12A and 12B a molded plastic or formed metal end portion 82 is provided with a shallow recess or tapered orifice 92 formed in the leaf 84. The end of the intermediate portion 70 is provided with one, or a pair of integrally formed projecting engagement members 74 that are adapted to receive and retain the recess or orifice 92 in end portion 84. In constructing the underwire assembly of this embodiment, the walls 76 forming the channel 72 are sufficiently resilient to receive leaf 84 in a snap-fit relation. As will apparent to one of ordinary skill in the art, a single integrally molded hinge-pin can be molded in one side of channel 72 in place of the pair of opposed projecting retaining elements 74, and orifice 92 is sized to receive the pin in close-fitting rotational relation.

As will also be understood by one of ordinary skill in the art, as well as by sales and fitting personnel, and even wearers of supporting garments, the discomfort experienced by individuals wearing the same supporting garment can be in different areas of their respective torsos. For this reason, it is another aspect of the invention to provide a department store or other specialty retailer with trial fitting garments from which the underwire of the invention to provide a department store or other specialty retailer with trial fitting garments from which the underwire of the invention can be removed and replaced with an alternative underwire to maximize the comfort of the wearer.

For example, the prospective buyer will first try on a brassiere having a standard underwire of the prior art for the purpose of identifying any pressure points or discomfort zones associated with bending, twisting or other movement and positions of the torso. The sales person will take note of any such locations and then select from a collection of properly sized underwires, one that includes the one or more zones of increased flexibility that correspond to the discomfort zones identified by the prospective buyer. A second trial fitting proceeds as above, and if satisfied, the buyer is provided with a new brassiere into which is assembled the selected underwire.

The underwires are permanently sealed into the receiving channel or sleeve, as by fabric adhesive applied by the sales personnel, or by simple tacking or stitching. The underwire can be provided with a hot melt adhesive that is activated by a clothing iron or microwave radiation. Alternatively, the garment can be provided with a retaining flap or overlapping pocket at the open end of the sleeve that is closed after insertion in order to retain the underwire. In another embodiment, the channel or sleeve can be closed using ultrasonic or sonic sealing methods and apparatus that are well known in the art.

In this manner, the wearer can be provided with a custom fitting of the garment, for which comfort and service a premium price can be charged.

It will be apparent to those skilled in the art that various modifications can be made to the present invention without departing from the spirit and scope of the invention. It is therefore intended that the present invention encompass all such modifications and variations so long as they fall within the scope of the appended claims and their equivalents.

What is claimed is:

1. An underwire for use in supporting garments comprising:

a generally U-shaped arcuate member the longitudinal axis of which lies in a plane, the arcuate member having a first portion extending from a first end that includes a majority of the length of the arcuate member, and a second portion that includes the remainder of the arcuate member, the second portion having a uniform reduced transverse cross-sectional area and a plurality of perforations substantially greater flexibility than the first portion in response to a force applied in a direction normal to the plane of the longitudinal axis of the arcuate member, whereby the second portion defines a zone of increased flexibility.

2. The underwire of claim 1, wherein the transverse cross-sectional area of the underwire along the longitudinal axis of the first portion is substantially uniform from proximate the first end to the junction of the first portion with the second portion and the cross-sectional area of the second portion is less than that of the first portion.

3. The underwire of claim 2, wherein the cross-sections of the first and second portions are generally rectilinear and the width of the underwire is uniform along substantially its entire length.

4. The underwire of claim 1, wherein the thickness of the arcuate member along the zone of increased flexibility of the second portion is less than the thickness of the first portion, as measured normal to the plane of the longitudinal axis.

5. The underwire of claim 4, wherein one longitudinal surface of the second portion of the arcuate member is displaced from the adjacent surface of the first portion.

6. The underwire of claim 4, wherein the opposing longitudinal surfaces of the second portion of the arcuate member are displaced from the adjacent surfaces of the first portion.

7. The underwire of claim 1, wherein the arcuate member is a flat metal strip having a width W that is greater than the thickness $T_1$ of both the first portion and the thickness $T_2$ of the second portion, and wherein $T_1$ is greater than $T_2$.

8. The underwire of claim 1, wherein the arcuate member is formed from a resilient polymer material.

9. The underwire of claim 8, wherein the polymeric material is selected from the group consisting of polyethylene, polypropylene, polyvinyl chloride, acrylonitrile-butadiene, styrene, methacrylates, polycarbonates, nylon and copolymers and homopolymers of these compounds.

10. The underwire of claim 1, wherein the second portion is provided with a plurality of openings extending through its longitudinal surfaces.

11. The underwire of claim 10, wherein an opening is circular.

12. The underwire of claim 10, wherein an opening is oblong.

13. The underwire of claim 1 further comprising a cushion tip of a soft material positioned on at least one of the ends of the arcuate member.

14. The underwire of claim 1 further comprising a dip tip of a polymeric material.

15. The underwire of claim 1, wherein the arcuate member is metal.

16. The underwire of claim 15, wherein at least one of the first and second portions are heat treated.

17. The underwire of claim 15 which further includes a polymer coating.

18. The underwire of claim 4 that is a metal stamping.

19. The underwire of claim 1 that is formed from two or more different materials that are joined.

20. An underwire for brassieres comprising:

a substantially U-shaped frame member having a first terminal end portion, a second terminal end portion, and an intermediate portion located between and integral with the first and second terminal end portions;

the second terminal end portion comprising a flexible zone of predetermined length having a plurality of perforations, such that the second terminal end portion has greater lateral flexibility than the intermediate portion.

21. The underwire of claim 20 in which the first terminal end portion has greater lateral flexibility than the intermediate portion.

22. The underwire of claim 20 further comprising at least one cushion tip located on the end of the second terminal end portion.

23. The underwire of claim 20 further comprising at least one dip tip of polymeric material.

24. The underwire of claim 20, wherein the frame member is metal.

25. The underwire of claim 20, wherein the frame member is a polymeric material.

26. An underwire for a brassiere comprising;

a substantially U-shaped frame member having a first terminal end portion, a second terminal end portion, and an intermediate portion located between and integral with the terminal end portions;

the first terminal end portion assembled in the garment at a location proximate a wearer's arm; the first portion comprising a flexible zone of predetermined length having a plurality of perforations, and the second terminal end portion comprising a flexible zone of predetermined length having a plurality of perforations, wherein the first and second terminal end portions have greater lateral flexibility than the intermediate portion.

27. The underwire of claim 26, wherein the flexibility of the first and second end portions relative to the intermediate portion are the same.

28. The underwire of claim 26 that is metal.

29. The underwire of claim 25 that is coated with a polymeric composition.

30. The underwire of claim 28, wherein the perforations are of uniform size.

31. The underwire of claim 28, wherein the perforations are oblong.

32. The underwire of claim 26, where the length of each of the first and second portions is from 10% to 20% of the length of the longitudinal axis of the underwire.

33. An underwire for supporting a cup of a brassiere comprising:

a generally U-shaped planar resilient arcuate member having a first flat portion extending along the longitudinal axis of the member approximately 65% to 90% of the length from a first end of the arcuate member; and a second portion with a plurality of perforations which render it more flexible relative to the first portion extending from its junction with the first portion to the second end of the arcuate member, whereby the second portion deflects more readily than the first portion in response to a force applied normal to the plane of the longitudinal axis of the member and the arcuate rigidity of the U-shaped member is substantially uniform along its length.

34. The underwire of claim 33, wherein the arcuate rigidity of the U-shaped member is substantially uniform along its length.

35. The underwire of claim 33, wherein the first portion extends approximately 85% to 90% of the length along the longitudinal axis of the arcuate member.

36. A supporting garment constructed with the underwire of claim 1.

37. The supporting garment of claim 36, wherein the underwire is metal and the second portion comprises from about 10% to 20% of the longitudinal length of the underwire.

38. The supporting garment of claim 37, wherein the underwire is coated with a polymer.

39. The supporting garment of claim 37, wherein at least one end of the underwire is fitted with a cushion tip.

40. An underwire for use in supporting garments comprising:

an arcuate frame member having a first end portion, a second end portion, and an intermediate portion located between and joined to the first and second end portions;

wherein at least one of the first or second end portions or an intermediate portion comprises a zone of predetermined length having a uniformly reduced traverse cross-sectional area with a plurality of peforations which provide greater lateral flexibility than an adjacent portion.

41. The underwire of claim 40 in which one or both of the first and second end portions has greater lateral flexibility than the intermediate portion.

42. The underwire of claim 40 in which the intermediate portion has at least one zone of greater lateral flexibility than an adjacent segment of the intermediate portion.

43. Method of custom-fitting a supporting garment that includes an underwire to a wearer of the supporting garment, the method comprising:

a. providing a plurality of underwires, each underwire being defined by an arcuate member having one or more portions of greater lateral flexibility than an adjacent portion along the longitudinal axis of the underwire;

b. placing a first underwire selected from the plurality of underwires in supporting position in the supporting garment;

c. placing the supporting garment on the wearer;

d. identifying any locations of discomfort caused by the underwire to the wearer;

e. replacing the first underwire with a second underwire having one or more portions of greater flexibility that correspond to the location or locations of discomfort when the second underwire is placed in the supporting garment;

f. repeating step d and step e, if necessary, until the discomfort to the wearer of the supporting garment is minimized;

g. securing the underwire resulting from step f in the supporting garment.

44. the method of claim 43, which includes the further step of placing in portion of the garment an underwire that is of uniform lateral flexibility to thereby provide a basis of comparison of relative discomfort during the fitting.

45. The method of claim 43, wherein the plurality of underwires have one or more portions of greater lateral flexibility that vary among the plurality of underwires.

46. The method of claim 43, wherein the underwires are provided with indicia to identify the number and location of the portions of greater lateral flexibility.

47. The method of claim 43, wherein the underwire is secured in the garment by adhesive.

48. The method of claim 47, where the adhesive is a hot melt adhesive.

49. The method of claim 43 where the underwire is secured in the garment by ultrasonic welding.

50. An underwire for supporting a cup of a brassiere comprising:

a generally U-shaped planar resilient arcuate member having a first flat portion extending along the longitudinal axis of the member approximately 85% to 90% of the length from a first end of the arcuate member; and a second portion with a plurality of peforations which render it more flexible relative to the first portion extending from its junction with the first portion to the second end of the arcuate member, wherein the second portion deflects more readily than the first portion in response to a force applied normal to the plane of the longitudinal axis of the member and the arcuate rigidity of the U-shaped member is substantially uniform along its length.

51. An underwire for use in supporting garments comprising:

an arcuate frame member having a first end portion, a second end portion, and an intermediate portion located between and joined to the first and second end portions.

wherein at least one of the first or second end portions comprises a zone of predetermined length having greater lateral flexibility than an intermediate portion and the intermediate portion has at least one zone of greater lateral flexibility than an adjacent segment of the intermediate portion.

52. An underwire for a brassiere comprising:

a substantially U-shaped frame member having a first terminal end portion, a second terminal end portion, and an intermediate portion located between and integral with the terminal end portions:

the first terminal portion; adapted for assembly in the brassiere at a location proximate a wearer's arm; the first portion comprising a flexible zone of predetermined length having a plurality of perforations, wherein the first and second terminal end portions having greater lateral flexibility than the intermediate portion.

* * * * *

UNITED STATES PATENT AND TRADEMARK OFFICE

CERTIFICATE OF CORRECTION

PATENT NO. : 6,857,933 B2
APPLICATION NO. : 10/245470
DATED : February 22, 2005
INVENTOR(S) : Joseph Horta and Ajit Thakur It is certified that error appears in the above-identified patent and that said Letters Patent is hereby corrected as shown below:

Col. 10, Line 67, in claim 1, line 11, after "perforations", insert

--which provide--

Col. 13, Line 11, in claim 40, at line 8, change

"traverse"

to

--transverse--

Signed and Sealed this

Twenty-fifth Day of December, 2007

JON W. DUDAS
*Director of the United States Patent and Trademark Office*